US005759122A

United States Patent [19]

Yu

[11] Patent Number: 5,759,122

[45] Date of Patent: Jun. 2, 1998

[54] RACKET FOR A BALL CATCHING GAME

[76] Inventor: Chian-Ping Yu, No. 190 Her-Tzuoh Street, Fong-Yuan City, Taichung Hsien, Taiwan

[21] Appl. No.: 863,374

[22] Filed: May 27, 1997

[51] Int. Cl.[6] ..... A63B 49/02; A63B 51/04

[52] U.S. Cl. ..... 473/543; 473/516

[58] Field of Search ..... 473/522, 531, 473/532, 543, 517, 516

[56] References Cited

U.S. PATENT DOCUMENTS

| | | | |
|---|---|---|---|
| 1,531,778 | 3/1925 | Gallaudet | 473/543 |
| 3,891,211 | 6/1975 | Diefenbach | 473/532 |
| 4,575,083 | 3/1986 | Adam | 473/522 |
| 5,141,227 | 8/1992 | Flamm | 473/543 |
| 5,303,918 | 4/1994 | Liu | 473/543 X |
| 5,413,335 | 5/1995 | Braun | 473/532 X |

*Primary Examiner*—William E. Stoll

*Attorney, Agent, or Firm*—Morton J. Rosenberg; David I. Klein; Jun Y. Lee

[57] ABSTRACT

A racket for a ball catching game includes a first frame with a first throat, a second frame with a second throat, a handle securely mounted between the first throat and the second throat, and a net securely mounted between the first and second frames. The net includes two spaced rigid lines formed thereon to thereby define a runway for the ball.

2 Claims, 7 Drawing Sheets

RACKET FOR A BALL CATCHING GAME

BACKGROUND OF THE INVENTION

1. Field of the Invention

The present invention relates to a racket for a ball catching game.

2. Description of the Related Art

A typical racket for a ball catching game is illustrated in FIG. 7 of the drawings. The racket includes a handle 30 and a ball catching member 31 which is integral with the handle 30. The ball catching member 31 includes a recess defined therein and a number of holes 32 for reducing the air friction. In use, one player may use the recess of the ball catching member 31 to catch a ball thrown by the other user and then swing the racket toward the other user to thereby throw the ball back to the other user. The two players repeat the throw-catch motions in this game. Nevertheless, the racket is not flexible since it is generally integrally made by plastics such that the ball tends to rebound out of the ball catching member 31 and thus affects the mood of the players since the game is too difficult to play.

Therefore, there has been a long and unfulfilled need for an improved racket for a ball catching game which mitigates and/or obviates the above problems.

SUMMARY OF THE INVENTION

It is an object of the present invention to provide a racket for a ball catching game which allows the ball to be easily caught by the racket.

A racket for a ball catching game in accordance with the present invention comprises a first frame with a first throat, a second frame with a second throat, a handle securely mounted between the first throat and the second throat, and a net securely mounted between the first and second frames. The net comprises two spaced rigid lines formed thereon to thereby define a runway for the ball. Preferably, the two rigid lines are parallel to each other and extend along a length of the net.

Other objects, advantages, and novel features of the invention will become more apparent from the following detailed description when taken in conjunction with the accompanying drawings.

DESCRIPTION OF THE PREFERRED EMBODIMENTS

Figure 1:
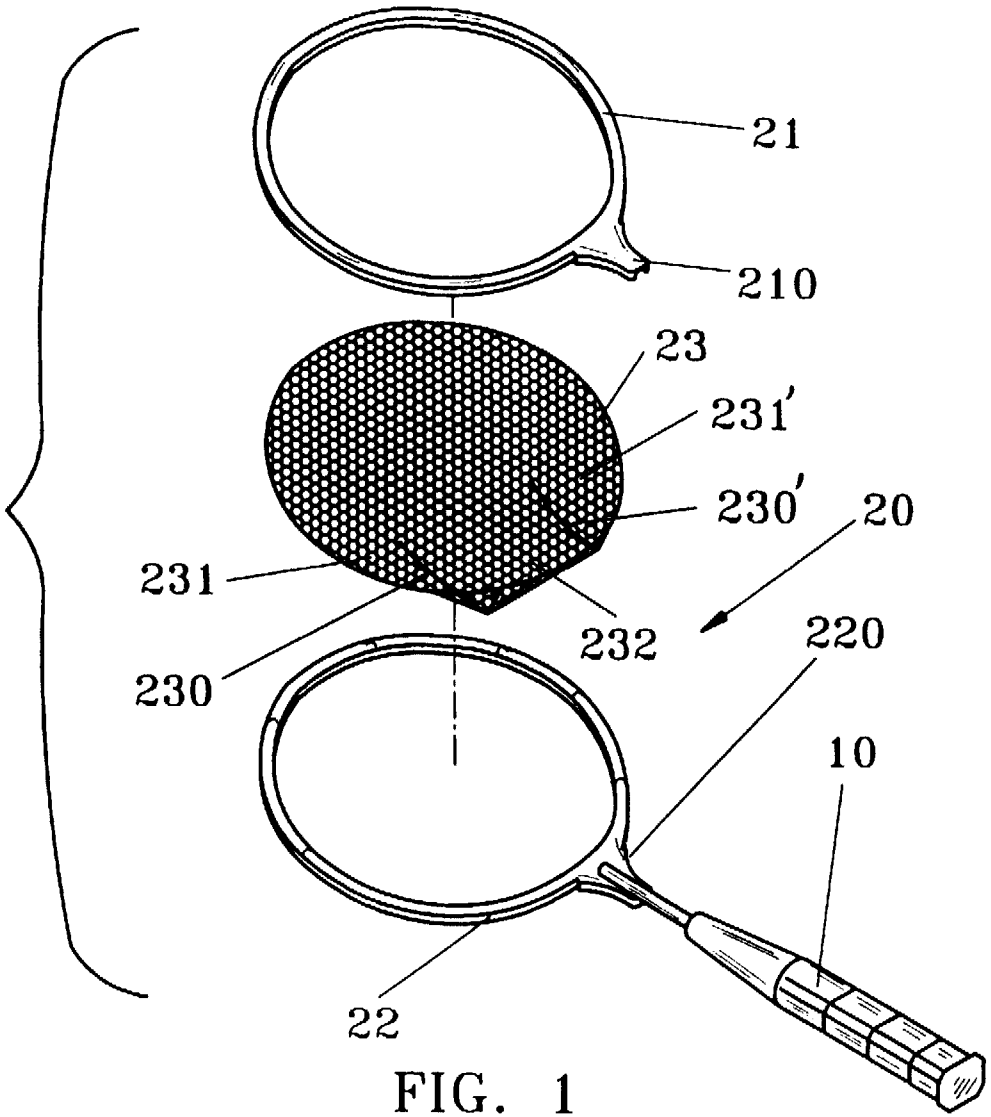
FIG. 1 is an exploded perspective view of a racket for a ball catching game in accordance with the present invention.
Figure 2:
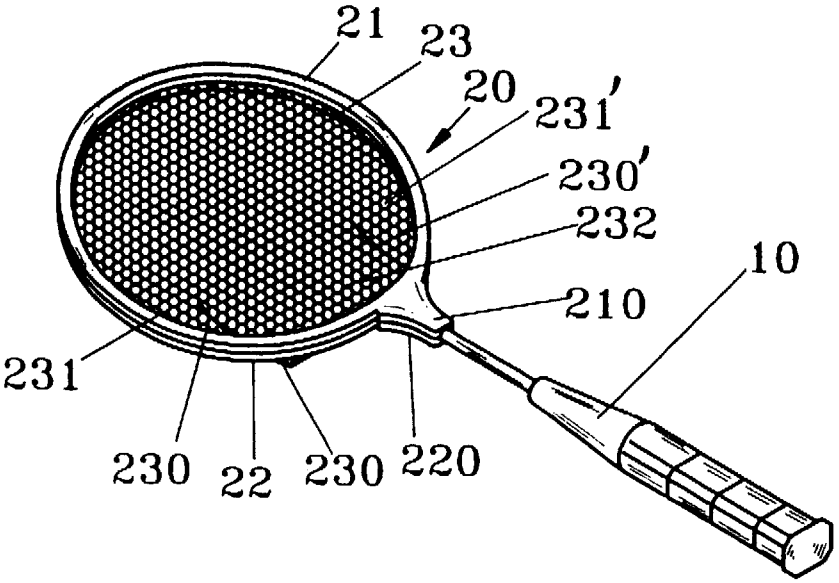
FIG. 2 is a perspective view of the racket in accordance with the present invention.

Referring to FIGS. 1 to 6 of the drawings and initially to FIGS. 1 and 2, a racket for a ball catching game in accordance with the present invention generally includes a handle 10 and a ball catching device 20 securely attached to the handle 10. The ball catching device 20 comprises a frame 200 including a first frame 21 with a throat 210 and a second frame 22 with a throat 220. The handle 10 is securely held between the throats 210 and 220. A net 23 is securely mounted between the first frame 21 and the second frame 22.

Figure 3:
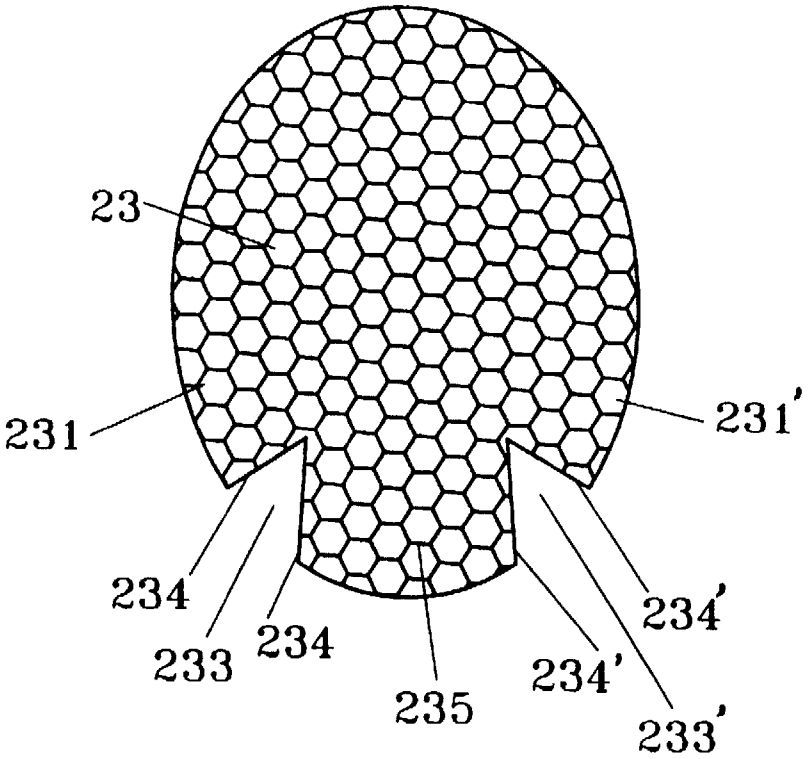
FIG. 3 is a front elevational view illustrating a net of the racket in an extended status.
Figure 4:
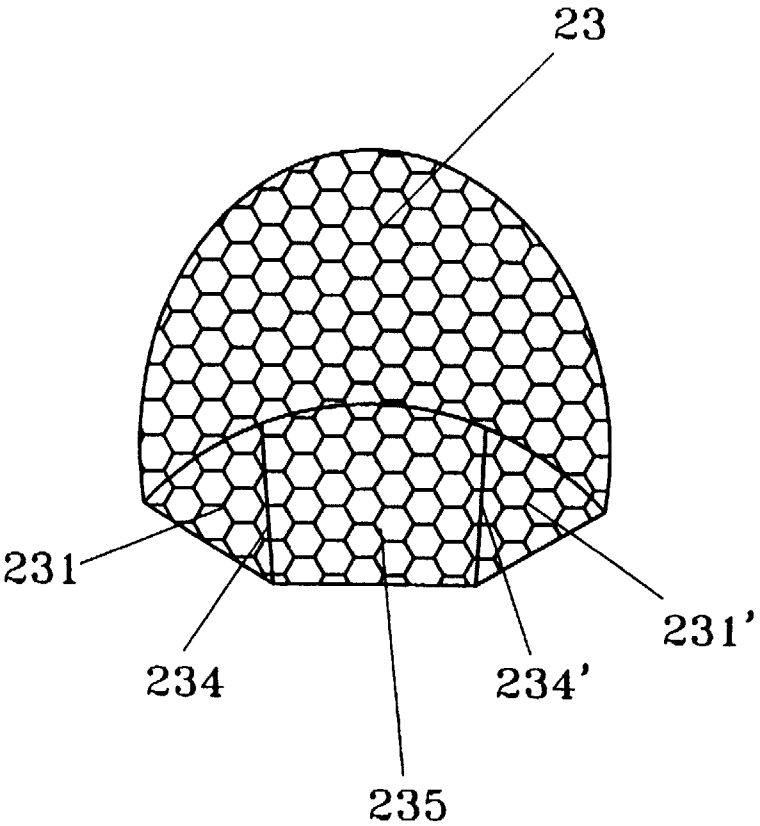
FIG. 4 is a front elevational view of the net in a folded status.
Figure 5:
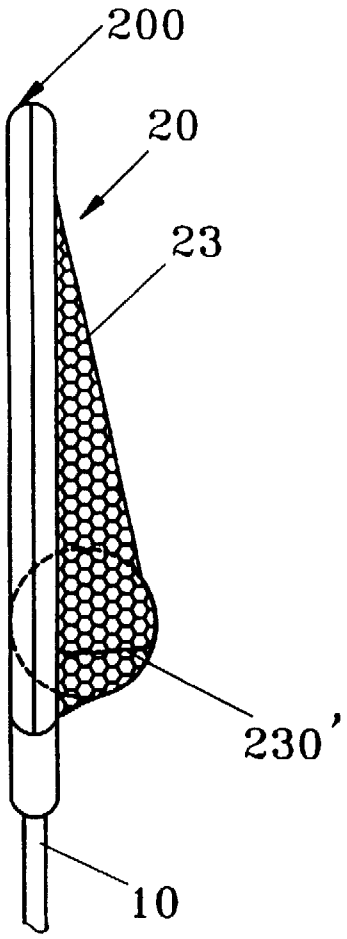
FIG. 5 is a side elevational view of the racket.

FIG. 3 illustrates an extended status of the net 23 which includes two notches 233, 233' defined by two sides 234, 234'. A stem portion 235 of the net 23 is bent upwardly, and a left side portion 231 as well as a right side portion 231' are then bent upwardly with the sides 234, 234' contact with each other, as shown in FIG. 4, in which glue or sewing can be applied to the sides 234, 234' to form two spaced rigid lines 230, 230' (see FIGS. 1 and 2).

Figure 6:
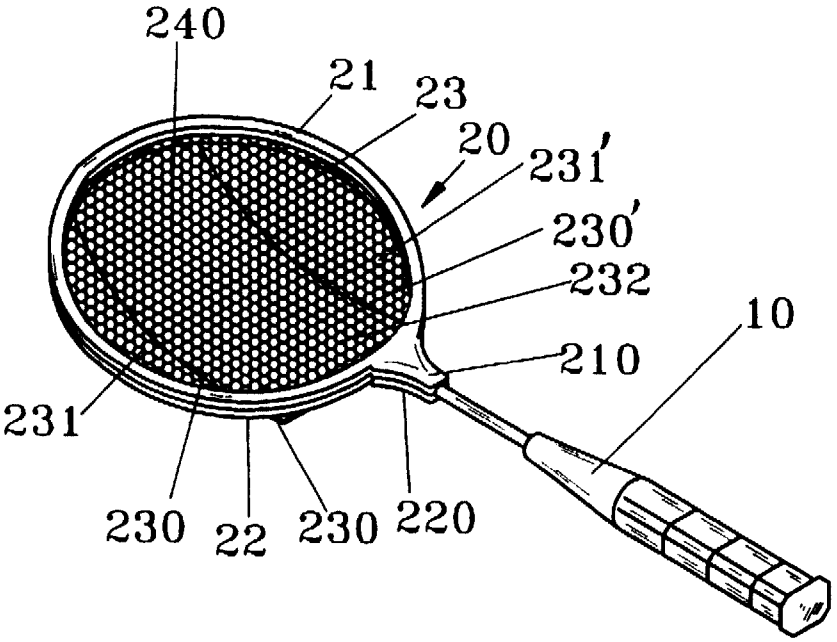
FIG. 6 is a perspective view illustrating a modified embodiment of the racket in accordance with the present invention.
Figure 7:
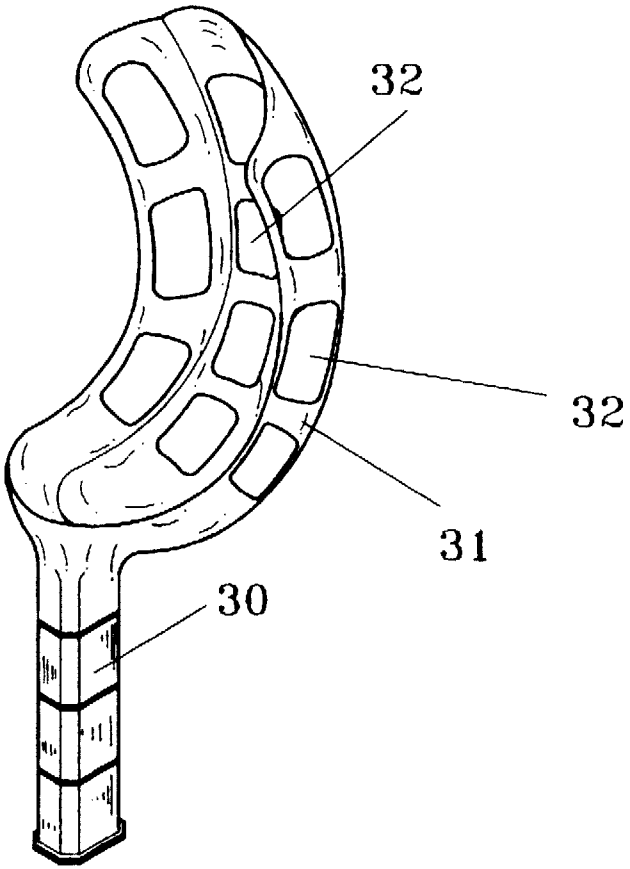
FIG. 7 PRIOR ART
FIG. 7 is a perspective view of a conventional racket for a ball catching game.

In use, the user may hold the handle 10 and catch a ball (not shown) thrown by the other user with the net 23. Then, the user may throw the ball back to the other user. The net 23 is soft and thus may securely catch the ball. In addition, the two rigid lines 230, 230' may define a runway therebetween for the ball to be thrown out in a smooth manner. FIG. 6 illustrates a modified embodiment of the present invention in which the two rigid lines 230, 230' are parallel and extend along a length the net 23.

Although the invention has been explained in relation to its preferred embodiment, it is to be understood that many other possible modifications and variations can be made without departing from the spirit and scope of the invention as hereinafter claimed.

What is claimed is:

1. A racket for a ball catching game, comprising a first frame with a first throat, a second frame with a second throat, a handle securely mounted between the first throat and the second throat, and a net securely mounted between the first frame and the second frame, the net comprising two spaced rigid lines formed thereon.

2. The racket according to claim 1, wherein the two rigid lines are parallel to each other and extend along a length of the net.

* * * * *